US009897385B2

(12) United States Patent
Myerholtz, Jr. et al.

(10) Patent No.: US 9,897,385 B2
(45) Date of Patent: Feb. 20, 2018

(54) HELICAL COIL HEATING APPARATUS AND METHOD OF OPERATION

(71) Applicant: Technologies Holdings Corp., Houston, TX (US)

(72) Inventors: Robert M. Myerholtz, Jr., Weston, OH (US); Larry L. Dancey, Melfort (CA)

(73) Assignee: Therma-Stor LLC, Madison, WI (US)

( * ) Notice: Subject to any disclaimer, the term of this patent is extended or adjusted under 35 U.S.C. 154(b) by 540 days.

(21) Appl. No.: 14/627,469

(22) Filed: Feb. 20, 2015

(65) Prior Publication Data

US 2016/0245590 A1 Aug. 25, 2016

(51) Int. Cl.

| | |
|---|---|
| ***F28D 7/02*** | (2006.01) |
| ***F28F 9/013*** | (2006.01) |
| *F24H 1/08* | (2006.01) |
| *F28D 1/02* | (2006.01) |
| *F28D 20/00* | (2006.01) |

(52) U.S. Cl.

CPC ..... *F28D 7/024* (2013.01); *F28F 9/013* (2013.01); *F24H 1/08* (2013.01); *F28D 1/0206* (2013.01); *F28D 20/0034* (2013.01)

(58) Field of Classification Search

CPC .. F24H 1/08; F28D 7/024; F28F 9/013; F28F 1/00

USPC ..... 126/344, 378.1; 165/145, 159

See application file for complete search history.

(56) References Cited

U.S. PATENT DOCUMENTS

| | | | | |
|---|---|---|---|---|
| 1,852,363 A * | 4/1932 | Parent | F28F 9/0132 | 165/162 |
| 2,980,404 A * | 4/1961 | Andersen | F28F 9/0132 | 165/162 |
| 4,088,184 A * | 5/1978 | Cavallaro | F28F 9/013 | 122/510 |
| 4,333,403 A * | 6/1982 | Tack | B61F 5/06 | 105/197.05 |
| 4,471,836 A * | 9/1984 | Hokanson | F28B 9/10 | 165/111 |

(Continued)

FOREIGN PATENT DOCUMENTS

WO 2014000017 1/2014

OTHER PUBLICATIONS

Canadian Intellectual Property Office Action, Application No. 2,882,516, 5 pages, dated Jul. 24, 2015.

*Primary Examiner* — Gregory Huson
*Assistant Examiner* — Nikhil Mashruwala
(74) *Attorney, Agent, or Firm* — Baker, Botts L.L.P.

(57) ABSTRACT

A heating apparatus comprises an exposed tube formed into an outer coil and an inner coil. The outer coil is formed around the inner coil with a gap separating the outer coil and the inner coil. The tube is supported by a support frame. The heating apparatus also comprises a spacer frame that extends from the top portion of the support frame to the base portion of the support frame. The spacer frame has a plurality of apertures formed therein, each aperture operable to support a corresponding ring of the outer coil. The apparatus also comprises a spacer rod having a first end that couples to the top portion of the support frame and a second end that couples to the base portion of the support frame, wherein the spacer rod is threaded through the spacer frame between the outer coil and the vertex of the spacer frame.

17 Claims, 5 Drawing Sheets

(56) References Cited

U.S. PATENT DOCUMENTS

| | | | | |
|---|---|---|---|---|
| 4,646,820 | A * | 3/1987 | Brightbill | F22B 21/26 165/145 |
| 4,771,738 | A * | 9/1988 | Ewbank | F22B 21/26 122/21 |
| 5,487,423 | A | 1/1996 | Romero | |
| 5,713,216 | A | 2/1998 | Erickson | |
| 6,102,106 | A | 8/2000 | Manning et al. | |
| 6,142,216 | A | 11/2000 | Lannes | |
| 6,276,264 | B1 | 8/2001 | Dumm | |
| 6,293,335 | B1 | 9/2001 | Tawney et al. | |
| 6,499,534 | B1 * | 12/2002 | Tawney | F28D 7/024 165/156 |
| 7,007,748 | B2 | 3/2006 | Gordon et al. | |
| 7,063,132 | B2 | 6/2006 | Gordon et al. | |
| 7,367,380 | B2 | 5/2008 | Lee et al. | |
| 7,549,462 | B2 | 6/2009 | Nuris et al. | |
| 7,607,471 | B2 | 10/2009 | Saika et al. | |
| 7,669,644 | B2 | 3/2010 | Alessandrini et al. | |
| 8,042,608 | B2 * | 10/2011 | Baker | F28D 7/022 165/165 |
| 8,069,676 | B2 | 12/2011 | Kamen et al. | |
| D655,801 | S | 3/2012 | Russell et al. | |
| 8,376,243 | B2 * | 2/2013 | Cloutier | F24H 1/52 122/15.1 |
| 2004/0149422 | A1 | 8/2004 | Jungwirth | |
| 2005/0145370 | A1 | 7/2005 | Merryfull | |
| 2010/0096115 | A1 | 4/2010 | Erickson | |
| 2010/0126432 | A1 | 5/2010 | Eberle et al. | |
| 2010/0319890 | A1 | 12/2010 | Tjernagel | |
| 2012/0060773 | A1 * | 3/2012 | Barendregt | F28D 1/0213 122/28 |
| 2012/0312253 | A1 | 12/2012 | Kita et al. | |
| 2013/0008635 | A1 | 1/2013 | Alessandrini | |
| 2013/0098586 | A9 | 4/2013 | Naukkarinen | |

* cited by examiner

HELICAL COIL HEATING APPARATUS AND METHOD OF OPERATION

TECHNICAL FIELD

This invention relates generally to a heating apparatus and specifically to a helical coil heating apparatus and method of operation.

BACKGROUND OF THE INVENTION

In many industries it is often necessary to heat liquids that exist in cold environments. Usually, these liquids are stored in tanks or other large reservoirs or they exist naturally in the environment. It is desirable to keep these liquids from freezing or to thaw these liquids if they do freeze. This is typically achieved by using heating mechanisms that are bulky, inefficient, and difficult to use.

SUMMARY OF THE INVENTION

According to embodiments of the present disclosure, disadvantages and problems associated with previous heating mechanisms may be reduced or eliminated.

In one embodiment, a heating apparatus comprises an exposed tube formed into an outer coil and an inner coil. In the apparatus, each coil is formed of a plurality of rings that are arranged to extend in a longitudinal direction. The outer coil is formed around the inner coil with a gap separating the outer coil and the inner coil. The tube has a first end that terminates the outer coil and a second end that terminates the inner coil. The apparatus also comprises support frame comprising a base portion, a body portion, and a top portion. The top portion of the support frame is arranged transverse to the longitudinal direction of the plurality of rings. The body portion of the support frame has a first end that is coupled to the top portion and a second end that is coupled to the base portion. The base portion comprises a plurality of legs and is arranged transverse to the longitudinal direction of the plurality of rings. The heating apparatus also comprises a spacer frame that extends from the top portion of the support frame to the base portion of the support frame. The spacer frame has a plurality of apertures formed therein, each aperture operable to support a corresponding ring of the outer coil such that at least one ring of the outer coil is separated from at least one other ring of the outer coil. The spacer frame has a vertex positioned between the inner coil and the outer coil. The apparatus also comprises a spacer rod having a first end that couples to the top portion of the support frame and a second end that couples to the base portion of the support frame, wherein the spacer rod is threaded through the spacer frame between the outer coil and the vertex of the spacer frame.

Certain embodiments may provide one or more advantages. One advantage of one embodiment may include the ability to heat toxic, corrosive, or any other type of contents safely. Another advantage may include the ability to use the same heating apparatus to heat contents of multiple different types of natural and artificial reservoirs. Yet another advantage may be the ability to heat contents quickly and through minimal heat loss.

Various embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

To provide a more complete understanding of the present disclosure and the features and advantages thereof, reference is made to the following description taken in conjunction with the accompanying drawings, in which.

DETAILED DESCRIPTION OF THE DRAWINGS

Figure 1:
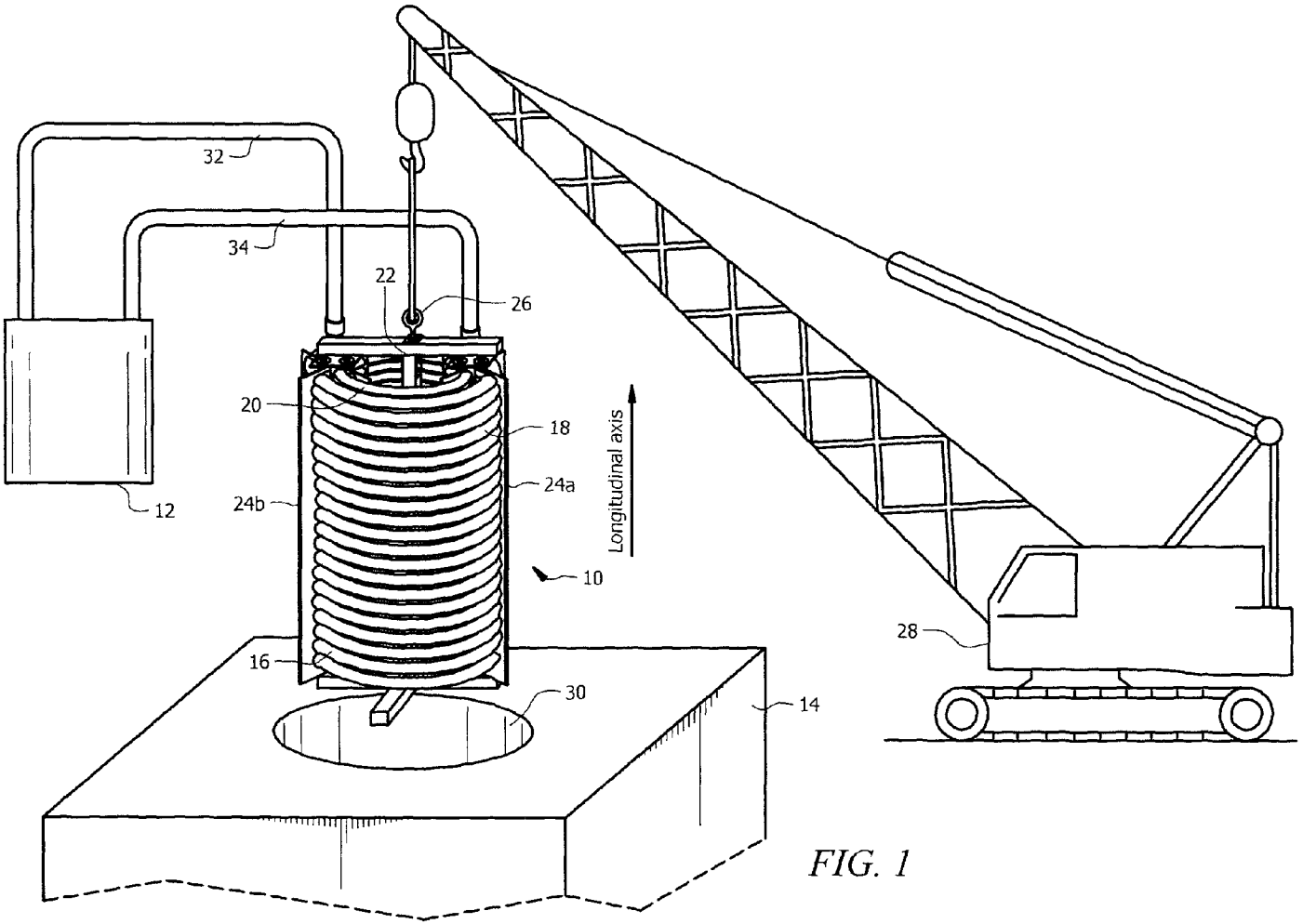
FIG. 1 illustrates a perspective view of a system for heating fluids using a helical coil heating apparatus.

FIG. 1 illustrates a perspective view of a helical coil heating apparatus 10 connected to a heater 12 by a supply line 32 and a return line 34. According to this embodiment, heating apparatus 10 comprises an exposed tube 16, support frame 22, and spacer frames 24*a* and 24*b*. Tube 16 is formed into an outer helical coil 18 and an inner helical coil 20. Spacer frames 24*a* and 24*b* are attached to outer helical coil 18. In this embodiment, heating apparatus 10 is heated by using fluid that is heated by heater 12. Here, tube 16 is supported by support frame 22. Support frame 22 has a hook 26. A crane 28 uses hook 26 to lower heating apparatus 10 into reservoir 14 through an opening 30. As heating apparatus 10 is lowered into reservoir 14, heating apparatus 10 comes in contact with the contents of reservoir 14 and heats those contents. In one embodiment, the contents of reservoir 14 may be frozen and heating apparatus 10 may be placed on top of the frozen contents to melt the frozen contents.

Heater 12 may be any system, device, or apparatus for heating a fluid. In various embodiments, heater 12 may be mobile or stationary. Heater 12 may be powered by any power source including generators, solar panels, batteries, the power grid, hydro-electric power, wind turbines, geothermal energy or any other power source. In some embodiments, heater 12 has multiple connections to connect multiple lines and is operable to heat fluids for multiple heating apparatuses 10. In the various embodiments, heater 12 may heat fluids to any suitable temperature. Heater 12 may also include or be coupled to a pump for pumping the heated fluid into the heated supply and return lines 32 and 34, respectively. In one embodiment, heater 12 may be connected to supply line 32 and return line 34 and heater 12 may both supply heated fluid and receive heated fluid. In another embodiment, heater 32 may only supply heated fluid.

Reservoir 14 may be any natural formation or artificial container including tanks, ponds, lakes, etc. Reservoir 14 may have an inlet or an outlet for fluid to enter or exit reservoir 14. In different embodiments, reservoir 14 may or may not be enclosed. Reservoir 14 may or may not be deep enough to submerge the entire heating apparatus 10. In one embodiment, reservoir 14 includes an opening 30 for accessing reservoir 14. Opening 30 may be large enough to insert heating apparatus 10. Reservoir 14 may be submerged, partially submerged, underground, partially underground, elevated off the ground, at ground level or in any other location. At different times of operation, reservoir 14 may be full, partially filled, or empty. Reservoir 14 may contain any substance in any form including any combination of liquids, solids, and gasses. For example, reservoir 14 may contain substances that are toxic, corrosive, flammable, edible, or potable. In one embodiment, reservoir 14 may contain frozen liquids. In various embodiments, reservoir 14 may be of any shape including a shape that may vary depending upon the contents of reservoir 14.

Crane 28 may be any system, device, or apparatus for moving any component of heating apparatus 10. In operation, crane 28 may couple with a hook 26 to lift any component of heating apparatus 10 and place it in any suitable location. Crane 28 may be mobile or stationary. Crane 28 may be powered by any power source including generators, engines, solar panels, batteries, gasoline, diesel, or any other power source. In some embodiments, crane 28 may be able to couple with multiple heating apparatuses 10 or may be able to couple with multiple portions of heating apparatus 10. Crane 28 may interact with heating apparatus 10 by any means for lifting any component of heating apparatus 10 including, for example, by hooks, a magnetic plate, a sack, a platform, or any other suitable mechanism or feature.

Supply line 32 and return line 34 may be made of any material and may have any suitable dimensions for transporting heated fluid. Lines 32 and 34 may be made of a flexible or a malleable material. At various times of operation, lines 32 and 34 may be partially filled with fluid, fully filled with fluid, or be empty. Lines 32 and 34 may carry glycol, water, oil, or any other suitable fluid that is heated by heater 12.

As discussed in greater detail below with respect to FIG. 2, heating apparatus 10 may comprise a tube 16 that is formed into an outer helical coil 18 and an inner helical coil 20. Tube 16 may be supported by a support frame 22. Spacer frames 24*a* and 24*b* may be attached to outer helical coil 18. In other embodiments, as discussed in greater detail below, additional spacer frames may be attached to inner helical coil 20.

In operation, heating apparatus 10 may heat the contents of reservoir 14 through a series of heat transfers. First, heater 12 may heat any fluid, for example, glycol, to a suitable temperature. Heater 12 may then pump that heated fluid into supply line 32. In one embodiment, supply line 32 may be coupled to outer helical coil 18. In another embodiment, supply line 32 may be coupled to a non-corrosive, thermally conductive extender that is coupled to outer helical coil 18 so that supply line 32 does not come in contact with contents of reservoir 14. The heated fluid may flow from heater 12 through supply line 32 into outer helical coil 18. Once the heated fluid is inside outer helical coil 18, heat energy may transfer from the heated fluid to outer helical coil 18. Because outer helical coil 18 may be in thermal contact with the contents of reservoir 14, heat energy may transfer from outer helical coil 18 to the contents of reservoir 14. As the contents closest to outer helical coil 18 are heated, they may become less dense and rise. The cooler contents of reservoir 14 may then flow towards outer helical coil 18 thereby heating the contents of entire reservoir 14 instead of just the contents adjacent to outer helical coil 18. The heated fluid inside outer helical coil 18 flows from outer helical coil 18 to inner helical coil 20. The heated fluid may continue to heat inner helical coil 20 in a similar manner. Inner helical coil 20 may also continue to heat the contents of reservoir 14. The heated fluid may become less hot as heat energy transfers from the heated fluid to helical coils 18 and 20. In one embodiment, inner helical coil 20 may be coupled to one end of return line 34. In another embodiment, return line 34 may be coupled to a non-corrosive, thermally conductive extender that is coupled to inner helical coil 20 so that return line 34 does not come in contact with contents of reservoir 14. The other end of return line 34 may be coupled to heater 12. The heated fluid may flow from inner helical coil 20 back to heater 12 through return line 34. Heater 12 may reheat the heated fluid and pump the heated fluid into supply line 32 to continuously heat the contents of reservoir 14.

Figure 2:
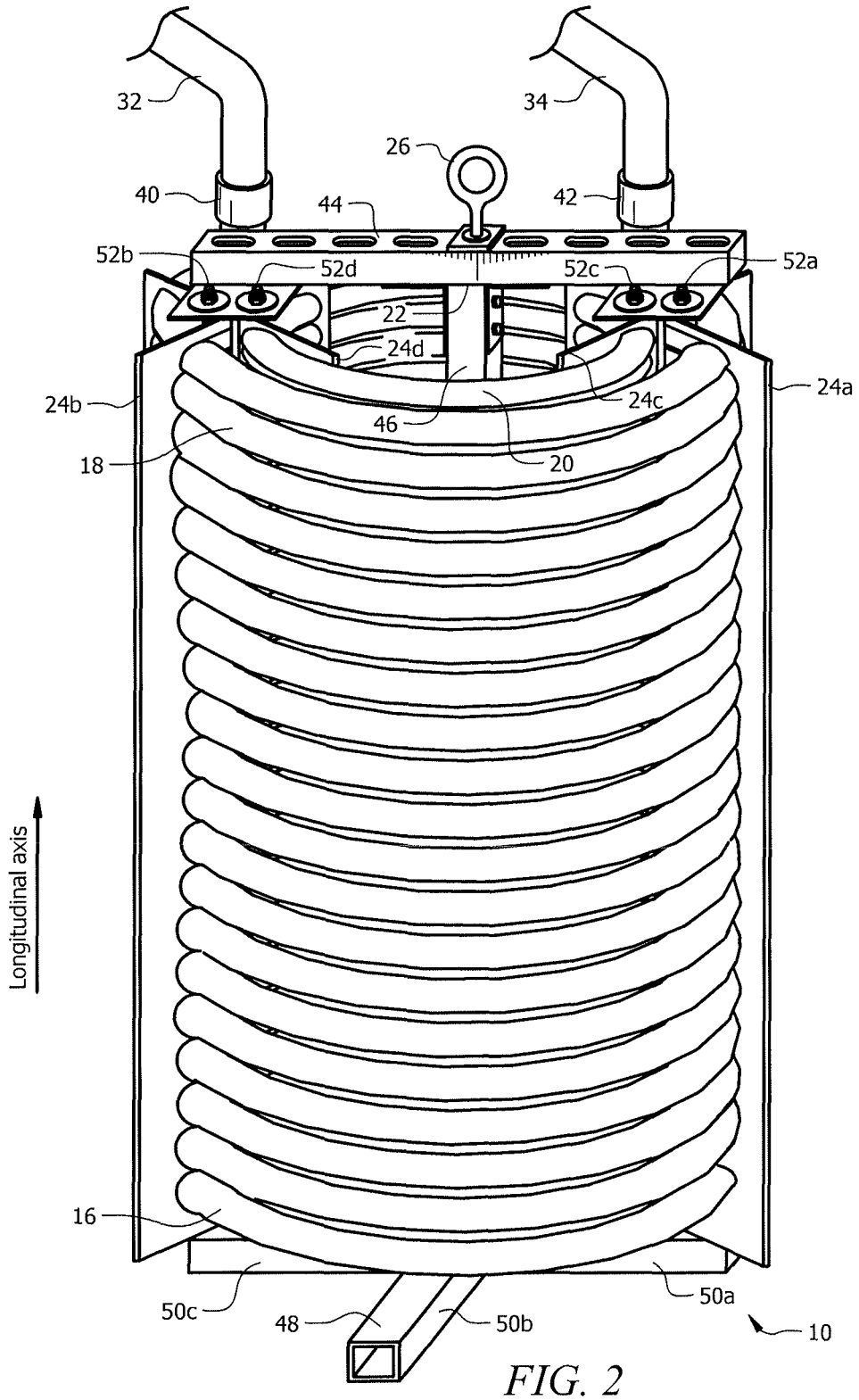
FIG. 2 illustrates one embodiment of a helical coil heating apparatus.

FIG. 2 illustrates one embodiment of helical coil heating apparatus 10 coupled to supply line 32 and return line 34. In this embodiment, exposed tube 16 is formed into an outer helical coil 18 and an inner helical coil 20. In other embodiments, tube 16 may have any number of coils. Outer helical coil 18 and inner helical coil 20 may be formed of a plurality of rings that are arranged to extend in a longitudinal direction. As shown, outer helical coil 18 is substantially cylindrical. It will be appreciated, however, that outer helical coil 18 may be of any shape. Similarly, as shown, inner helical coil 20 is substantially cylindrical. As with outer helical coil 18, inner helical coil 20 may be of any shape. As discussed below in relation to FIG. 5, in one embodiment, outer helical coils 18 and 20 may have one or more planar surfaces and may be shaped substantially as a "D." In the present embodiment, outer helical coil 18 is formed around inner helical coil 20 and there is a gap between outer helical coil 18 and inner helical coil 20. Outer helical coil 18 may be separated from inner helical coil 20 by any suitable means. In this embodiment, tube 16 has a first end 40 and a second end 42. First end 40 of tube 16 terminates outer helical coil 18. Second end 42 of tube 16 terminates inner helical coil 20. First end 40 and second end 42 may be next to each other and may face substantially the same direction. For example, in one embodiment, ends 40 and 42 may terminate in a position that is parallel to the longitudinal direction of the plurality of rings. Tube 16 may be made of any material including any thermally conductive material. In some embodiments, tube 16 may be made of a non-corrosive material such as stainless steel. Tube 16 may be of any shape. Tube 16 may be made of a flexible or malleable material. It may be possible to change the shape of tube 16 depending upon the intended use of heating apparatus 10. In the present embodiment, spacer frames 24*a* and 24*b* are used in conjunction with outer helical coil 18, and spacer frames 24*c* and 24*d* are used in conjunction with inner helical coil 20 as discussed in greater detail with respect to FIG. 4 below. Here spacer frames 24*a* and 24*b* are positioned on different portions of outer helical coil 18. Similarly, spacer frames 24*c* and 24*d* are positioned on different portions of inner helical coil 20. Although spacer frames 24*a* and 24*b* and spacer frames 24*c* and 24*d* are all illustrated herein, it should be understood that any number and combination of spacer frames 24 can be used depending on the particular needs of the heating apparatus 10. For example, in one embodiment, spacer frames 24*a* and 24*b* are used but not spacer frames 24*c* and 24*d*. In another embodiment, spacer frames 24*c* and 24*d* are used but not spacer frames 24*a* and 24*b*. In still another embodiment, one of spacer frames 24*a* and 24*b* is used along with one of spacer frames 24*c* and 24*d*. In still other embodiments, additional spacer frames 24 can be used in conjunction with outer coil 18 and/or additional spacer frames 24 can be used in conjunction with inner coil 20. As discussed in greater detail with respect to FIGS. 3 and 4 below, spacer frames 24*a-d* are additionally held in place on heating apparatus 10 by spacer rods 52*a-d*.

Support frame 22 may be any structure or apparatus for supporting tube 16. Support frame 22 may be made of any material including a thermally conductive material. In one embodiment, support frame 22 may be made of a non-corrosive material such as stainless steel. Different portions of support frame 22 may be made of different materials. In one embodiment, support frame 22 may comprise a top portion 44, a body portion 46, and a base portion 48. In another embodiment, support frame 22 may only comprise a top portion 44 and a base portion 48.

Top portion 44 may be any structure that forms one portion of support frame 22. Top portion 44 may be of any shape. Top portion 44 may be made of any material. In one embodiment, top portion 44 may be made of a non-corrosive, thermally conductive material such as stainless steel. Top portion 44 may comprise one or more hooks 26. In one embodiment, hooks 26 may be permanently attached to top portion 44. In another embodiment, hooks 26 may be removably coupled to top portion 44. In the various embodiments, hooks 26 may be attached near the middle of top portion 44, near the ends of top portion 44, or at any other part of top portion 44.

In one embodiment where support frame 22 has a body portion 46, body portion 46 may have a first end and a second end. The first end of body portion 46 may be coupled to top portion 44. The second end of body portion 46 may be coupled to base portion 48. Body portion 46 may be coupled to top portion 44 in any manner. In one embodiment, body portion 46 may be rotatably coupled to top portion 44 so that top portion 44 may be able to rotate around the axis of body portion 46 to increase the maneuverability of support frame 22. In another embodiment where support frame 22 does not have a body portion 46, top portion 44 may be connected to base portion 48 using spacer rods 52 as described in greater detail with respect to FIG. 3 below.

Base portion 46 may be any structure on which tube 16 can be placed. In one embodiment, base portion 48 may be attached to body portion 46. Base portion 48 may have any suitable number of legs 50. In some embodiments, base portion 48 may be a rectangular or disk shaped plate. Base portion 48 may have any suitable dimensions. In one embodiment, the dimensions of base portion 48 may be different from the dimensions of top portion 44. Base portion 48 may be made of any material. In one embodiment, base portion 48 may be made of a non-corrosive, thermally conductive material such as stainless steel.

In this example embodiment, outer helical coil 18 and inner helical coil 20 of tube 16 are placed upon base portion 48 of support frame 22. In other embodiments, base portion 48 may only support inner helical coil 20 and not outer helical coil 18. In the present embodiment, top portion 44 is arranged transverse to the longitudinal direction of the plurality of rings forming outer coil 18 and inner coil 20. Here, both outer helical coil 18 and inner helical coil 20 come in thermal contact with base portion 48. In this embodiment, base portion 48 comprises legs 50*a*, 50*b*, 50*c*, and 50*d* (50*d* is not shown) and base portion 48 is also arranged transverse to the longitudinal direction of the plurality of rings forming outer coil 18 and inner coil 20. In this embodiment, outer helical coil 18 and inner helical coil 20 are placed around body portion 46 of support frame 22. In other embodiments, support frame 22 may not have a body portion 46 and outer coil 18 and inner coil 20 may be placed on support frame 22 using spacer rods 52 as described below with respect to FIG. 3. In the present embodiment, both first end 40 and second end 42 of tube 16 face substantially the same direction and terminate adjacent to top portion 44. Ends 40 and 42 may be attached to top portion 44 of support frame 22. In this embodiment, first end 40 and second end 42 are both positioned parallel to the longitudinal direction of the plurality of rings to aid with connecting ends 40 and 42 to lines 32 and 34 when heating apparatus 10 is lowered into a reservoir 14 in a longitudinal position. In other embodiments, first end 40 and second end 42 may be attached to different portions of support frame 22 or may remain unattached.

In operation, one end of supply line 32 is coupled to heater 12 and the other end of supply line 32 is coupled to first end 40 of outer helical coil 18. Here, supply line 32 may be coupled to outer helical coil 18 in any manner including by using quick couplers so that supply line 32 may be easily coupled and decoupled from outer helical coil 18. In other embodiments, supply line 32 may be coupled to a non-corrosive, thermally conductive extender that is coupled to outer helical coil 18 in any manner including by using quick couplers. Outer helical coil 18 runs substantially the entire length of tube 16 and forms the outer surface of tube 16. Outer helical coil 18 then connects with inner helical coil 20. In some embodiments, outer helical coil 18 and inner helical coil 20 may be two distinct coils that are connected together in any suitable manner. In other embodiments, outer helical coil 18 and inner helical coil 20 may be formed of one tube 16. Inner helical coil 20 also runs substantially the entire length of tube 16 and forms the inner surface of tube 16. Second end 42 of inner helical coil 20 is coupled to one end of return line 34. Here, return line 34 may be coupled to inner helical coil 20 in any manner including by using quick couplers so that return line 34 may be easily coupled and decoupled from inner helical coil 20. In other embodiments, return line 34 may be coupled to another non-corrosive, thermally conductive extender that is coupled to inner helical coil 20 in any manner including by using quick couplers. The other end of return line 34 is coupled to heater 12. It will be appreciated that in other embodiments, heating apparatus 10 may only have one coil 18 and this coil 18 may be connected to both supply line 32 and return line 34. Similarly, in some embodiments, return line 34 may not connect to heater 12 but may instead remain unattached, may connect to a tank, a well, or any other container or reservoir.

Figure 3:
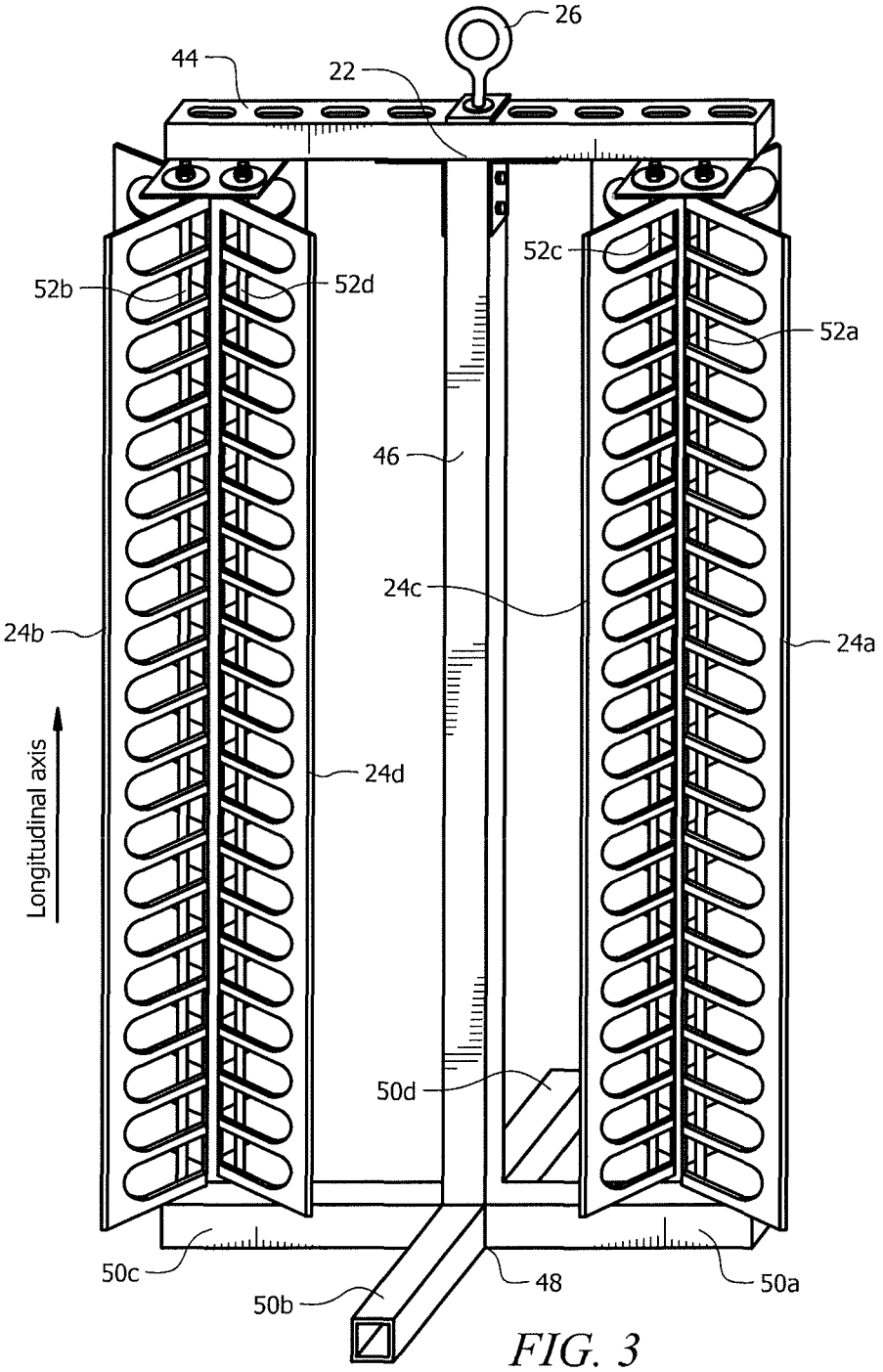
FIG. 3 illustrates one embodiment of a support frame and four spacer frames and spacer rods.

FIG. 3 illustrates one embodiment of a support frame 22, four spacer frames 24*a*, 24*b*, 24*c*, and 24*d*, and four spacer rods 52*a*, 52*b*, 52*c*, and 52*d*. In this illustration, inner coil 20 and outer coil 18 are not depicted so as to more clearly show the other elements of heating apparatus 10. In this embodiment, support frame 22 is a frame comprising a top portion 44, a body portion 46, and a base portion 48. Here, top portion 44 is a rectangular beam.

Body portion 46 may be attached to top portion 44 and may be substantially transverse to top portion 44. In one embodiment, body portion 46 may be attached near the middle of top portion 44. In one such embodiment, body portion 46 and top portion 44 form a substantially "T" shape. In some embodiments, body portion 46 may be aligned with one or more hooks 26. Body portion 46 is made of any material. In one embodiment, body portion 46 may be made of a non-corrosive, thermally conductive material such as stainless steel. Body portion 46 may be extendable. In one embodiment, body portion 46 may be made of layered beams so that body portion 46 may be extended by sliding the layered beams.

In one embodiment, base portion 48 may be attached to body portion 46. As one example, base portion 48 may be substantially transverse to body portion 46 and substantially parallel to top portion 44. In this example embodiment, base portion 46 has four legs 50*a*, 50*b*, 50*c*, and 50*d* that are evenly spaced apart from each other. In other embodiments, base portion 46 may have more or less than four legs. Legs

50*a*, 50*b*, 50*c*, and 50*d* may be of any width or of any length. In other embodiments, support frame 22 may not have a body portion 46 and base portion 48 may be connected to top portion 44 by coupling one end of a spacer rod 52 to top portion 44 and the other end of spacer rod 52 to base portion 48 of support frame 22 as described below.

Spacer rods 52*a-d* may be any rods that keep spacer frames 24*a-d* from sliding off of tube 16 and for connecting top portion 44 to base portion 48. Spacer rods 52*a-d* may be bald or partially or entirely threaded. Spacer rods 52*a-d* may be made of any material including any thermally conductive non-corrosive material such as stainless steel. In the present embodiment, one end of spacer rods 52*a-d* is coupled to top portion 44 and the other end of spacer rods 52*a-d* is coupled to base portion 48 of support frame 22. In the present embodiment, spacer frames 24*a-d* are placed so that they are substantially aligned with legs 50*a-d* of base portion 48. In this manner, spacer rods 52*a* and 52*b* can be placed between outer coil 18 and spacer frame 24*a* and 24*b* and be coupled to top portion 44 as well as legs 50*a* and 50*c* of base portion 48. Similarly, spacer rods 52*c* and 52*d* can be placed between inner coil 20 and spacer frame 24*c* and 24*d* and be coupled to top portion 44 as well as legs 50*a* and 50*c* of base portion 48. Spacer rods 52*a-d* may thus prevent coils 18 and 20 from sliding out of spacer frames 24. In other embodiments, where base portion 48 is not comprised of legs 50, spacer rod 52 may be connected to any part of base portion 48.

Figure 4:
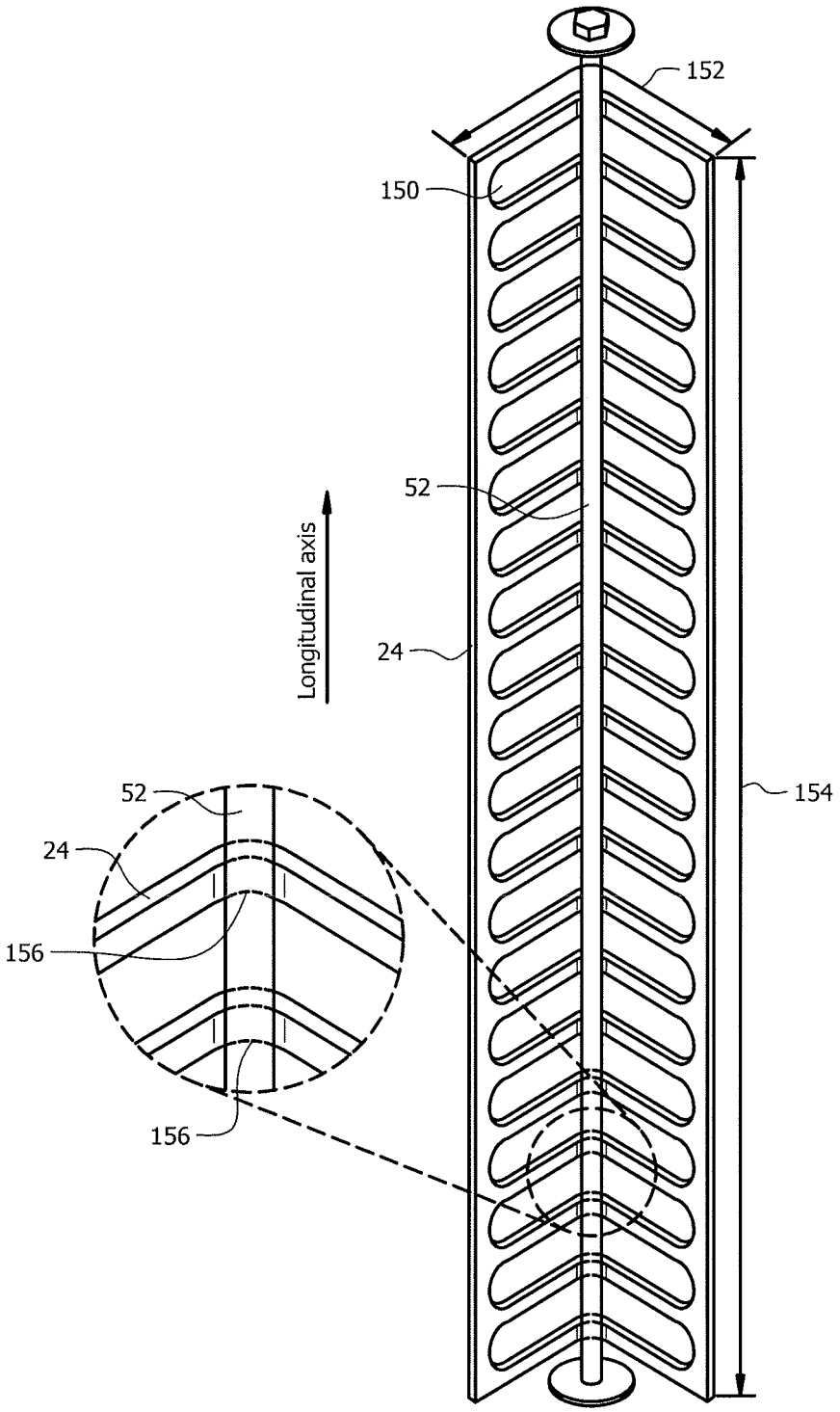
FIG. 4 illustrates one embodiment of a spacer frame and a spacer rod used in the helical coil heating apparatus of FIG. 2.

FIG. 4 illustrates one embodiment of a spacer frame 24 and a spacer rod 52. Spacer frame 24 may be made of any material including any thermally conducting, non-corrosive material such as stainless steel. In this embodiment, spacer frame 24 is a rectangular sheet having a width 152 and a length 154. Apertures 150 are formed in a line along length 154 of spacer frame 24. Each aperture 150 is of a rounded rectangular shape with two linear sides and two rounded sides. In other embodiments, apertures 150 may be of any shape. Each aperture is big enough to hold a corresponding ring of helical coil 18 or 20. In some embodiments, apertures 150 may be larger than the rings of helical coils 18 or 20. In other embodiments, apertures 150 may be smaller than the rings of helical coil 18 or 20 and may need to be deformed to hold the rings of coils 18 or 20 more tightly. Spacer frame 24 is bent near the middle of width 152 of spacer frame 24 to form a substantially "v" shape with vertices 156. Vertices 156 may be substantially aligned along the center of each apertures 150. In other embodiments, spacer frame 24 may be rounded to form a substantially "u" shape with the curved portion. The curved portion of that embodiment may by substantially aligned along the center of each aperture 150.

In operation, spacer frame 24 may be attached to outer helical coil 18 and/or inner helical coil 20 as shown above in FIG. 2. When attached to outer helical coil 18, each ring of outer helical coil 18 may be placed in each aperture 150 so that each ring of outer helical coil 18 is separated from at least one other ring of outer helical coil 18. Here, vertices 156 may be placed in between outer helical coil 18 and inner helical coil 20. Spacer rod 52 may be threaded through outer helical coil 18 and vertices 156 of spacer frame 24. When attached to inner helical coil 20, each ring of inner helical coil 20 may be placed in each aperture 150 so that each ring of inner helical coil 20 is separated from at least one other ring of inner helical coil 20. Here, vertices 156 may be placed in between outer helical coil 18 and inner helical coil 20. Spacer rod 52 may be threaded through inner helical coil 20 and vertices 156 of spacer frame 24. In both situations, spacer frame 24 may extend from the top portion 44 of support frame 22 to the base portion 48 of support frame 22. Similarly, in both situations, one end of spacer rod 52 may be coupled to top portion 44 and the other end of spacer rod 52 may be coupled to base portion 48 of support frame 22.

Figure 5:
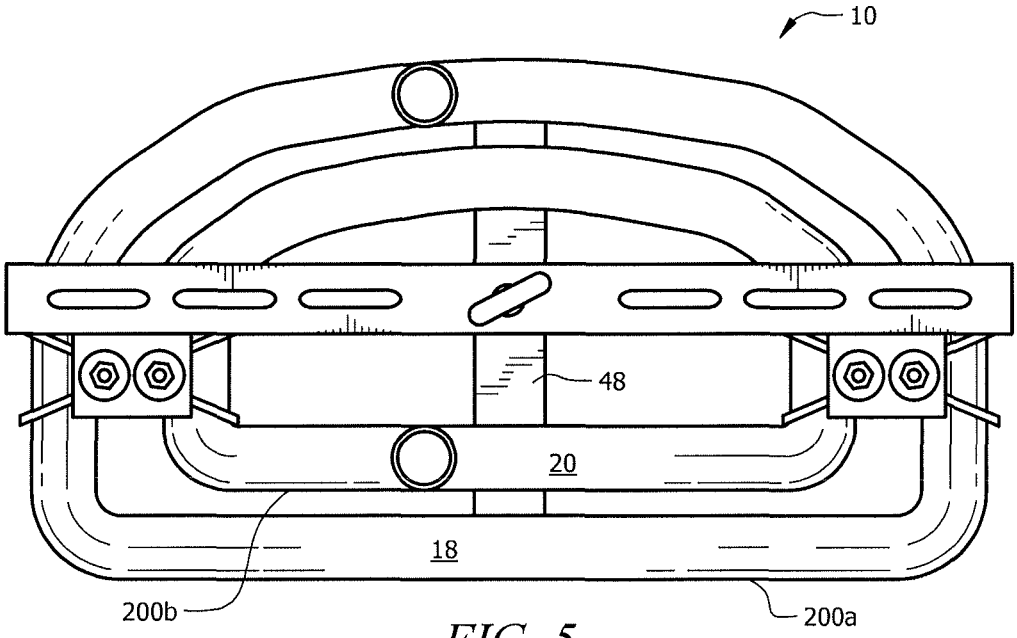
FIG. 5 illustrates a top down view of one embodiment of a helical coil heating apparatus.

FIG. 5 illustrates a top-down view of an example embodiment of heating apparatus 10 where outer coil 18 and inner coil 20 have substantially planar surfaces 200*a* and 200*b*. In the present embodiment, outer coil 18 is formed around inner coil 20 and both coils 18 and 20 are substantially "D" shaped. In other embodiments, outer coil 18 and inner coil 20 may be of different shapes. Although outer coil 18 and inner coil 20 each have one planar surface in the present embodiment, it will be appreciated that in other embodiments, coils 18 and 20 may have multiple planar surfaces.

In operation, heating apparatus 10 may be placed on its side so that planar surface 200*a* of heating apparatus 10 is in thermal contact with the contents that need to be heated. Placing the planar surface 200*a* of outer helical coil 18 in thermal contact with the contents may maximize the surface area of tube 16 that comes in contact with the contents. Maximizing the surface area of contact between tube 16 and the contents to be heated may reduce heat loss and increase heat transfer from the heating apparatus 10 to the contents. This embodiment may also prevent heating apparatus 10 from rolling when it is placed horizontally on a frozen surface.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. The methods may include more, fewer, or other steps. Additionally, steps may be performed in any suitable order. Additionally, operations of the systems and apparatuses may be performed using any suitable logic. As used in this document, "each" refers to each member of a set or each member of a subset of a set.

Although several embodiments have been illustrated and described in detail, it will be recognized that substitutions and alterations are possible without departing from the spirit and scope of the present disclosure, as defined by the appended claims. To aid the Patent Office, and any readers of any patent issued on this application in interpreting the claims appended hereto, applicants wish to note that they do not intend any of the appended claims to invoke 35 U.S.C. §112(f) as it exists on the date of filing hereof unless the words "means for" or "step for" are explicitly used in the particular claim.

What is claimed is:

1. A heating apparatus, comprising:

an exposed tube formed into an outer coil and an inner coil, wherein:

each coil is formed of a plurality of rings that are arranged to extend in a longitudinal direction;

the outer coil is formed around the inner coil with a gap separating the outer coil and the inner coil; and the tube has a first end that terminates the outer coil and a second end that terminates the inner coil;

a support frame comprising a base portion and a top portion, wherein:

the top portion is arranged transverse to the longitudinal direction of the plurality of rings; and the base portion comprises a plurality of legs and is arranged transverse to the longitudinal direction of the plurality of rings;

a first spacer frame that extends from the top portion of the support frame to the base portion of the support frame, the first spacer frame having a first frame portion and a second frame portion that meet at a vertex, the first and second frame portions having a plurality of apertures formed therein, each aperture operable to support a corresponding ring of the outer coil such that at least one ring of the outer coil is separated from at least one other ring of the outer coil, wherein the vertex is positioned between the inner coil and the outer coil;

a first spacer rod having a first end that couples to the top portion of the support frame and a second end that couples to the base portion of the support frame, wherein the first spacer rod is threaded through the first spacer frame between the outer coil and the vertex of the first spacer frame;

a second spacer frame that extends from the top portion of the support frame to the base portion of the support frame along a different portion of the outer coil than the first spacer frame, the second spacer frame having a first frame portion and a second frame portion that meet at a vertex, the first and second frame portions of the second spacer frame having a plurality of apertures formed therein, each aperture operable to support a corresponding ring of the outer coil such that at least one ring of the outer coil is separated from at least one other ring of the outer coil, wherein the vertex of the second spacer frame is positioned between the inner coil and the outer coil; and a second spacer rod having a first end that couples to the top portion of the support frame and a second end that couples to the base portion of the support frame, wherein the second spacer rod is threaded through the second spacer frame between the outer coil and the vertex of the second spacer frame.

2. The heating apparatus of claim 1, the heating apparatus further comprising:

a third spacer frame that extends from the top portion of the support frame to the base portion of the support frame, the third spacer frame having a first frame portion and a second frame portion that meet at a vertex, the first and second frame portions of the third spacer frame having a plurality of apertures formed therein, each aperture operable to support a corresponding ring of the inner coil such that at least one ring of the inner coil is separated from at least one other ring of the inner coil, wherein the vertex is positioned between the inner coil and the outer coil; and a third spacer rod having a first end that couples to the top portion of the support frame and a second end that couples to the base portion of the support frame, wherein the third spacer rod is threaded through the third spacer frame between the inner coil and the vertex of the third spacer frame.

3. The heating apparatus of claim 1, wherein the outer helical coil is D-shaped such that it has a substantially planar surface.

4. The heating apparatus of claim 1, wherein:

the outer coil is coupled to a supply line through which heated fluid flows into the tube; and the inner coil is coupled to a return line through which heated flow flows out of the tube.

5. The heating apparatus of claim 4, wherein the inner coil and the outer coil are each in thermal contact with the base portion of the support frame.

6. The heating apparatus of claim 4, wherein each of the first end of the tube and the second end of the tube terminate in a position that is parallel to the longitudinal direction of the plurality of rings.

7. The heating apparatus of claim 6, wherein the first end of the tube and the second end of the tube terminate adjacent to the top portion of the support frame.

8. The heating apparatus of claim 1, wherein the support frame further comprises a body portion that has a first end that is coupled to the top portion and a second end that is coupled to the base portion.

9. A method for using a heating apparatus, comprising:

operating a supply line that carries heated fluid;

operating a return line that carries the heated fluid;

coupling the supply line to a first end of the heating apparatus and coupling the return line to a second end of the heating apparatus, wherein:

the heating apparatus comprises a tube that is formed into an outer coil and an inner coil, each coil is formed of a plurality of rings that are arranged to extend in a longitudinal direction, the outer coil is formed around the inner coil with a gap separating the outer coil and the inner coil, and the first end terminates the outer coil and the second end terminates the inner coil;

the tube is supported by a support frame comprising a base portion and a top portion, wherein:

the top portion is arranged transverse to the longitudinal direction of the plurality of rings; and the base portion comprises a plurality of legs and is arranged transverse to the longitudinal direction of the plurality of rings;

a first spacer frame is attached to the outer coil so that the first spacer frame extends from the top portion of the support frame to the base portion of the support frame, the first spacer frame having a first frame portion and a second frame portion that meet at a vertex, the first and second frame portions having a plurality of apertures formed therein, each aperture operable to support a corresponding ring of the outer coil such that at least one ring of the outer coil is separated from at least one other ring of the outer coil, wherein the vertex is positioned between the inner coil and the outer coil;

a first spacer rod having a first end that is coupled to the top portion of the support frame and a second end that is coupled to the base portion of the support frame, wherein the first spacer rod is threaded through the first spacer frame between the outer coil and the vertex of the first spacer frame;

a second spacer frame that extends from the top portion of the support frame to the base portion of the support frame along a different portion of the outer coil than the first spacer frame, the second spacer frame having a first frame portion and a second frame portion that meet at a vertex, the first and second frame portions having a plurality of apertures formed therein, each aperture operable to support a corresponding ring of the outer coil such that at least one ring of the outer coil is separated from at least one other ring of the outer coil, wherein the vertex of the second spacer frame is positioned between the inner coil and the outer coil; and a second spacer rod having a first end that couples to the top portion of the support frame and a second end that couples to the base portion of the support frame, wherein the second spacer rod is threaded through the second spacer frame between the outer coil and the vertex of the second spacer frame.

10. The method of claim 9, wherein the heating apparatus further comprises:

a third spacer frame that extends from the top portion of the support frame to the base portion of the support frame, the third spacer frame having a first frame portion and a second frame portion that meet at a vertex, the first and second frame portions having a plurality of apertures formed therein, each aperture operable to support a corresponding ring of the inner coil such that at least one ring of the inner coil is separated from at least one other ring of the inner coil, wherein the vertex is positioned between the inner coil and the outer coil; and a third spacer rod having a first end that couples to the top portion of the support frame and a second end that couples to the base portion of the support frame, wherein the third spacer rod is threaded through the third spacer frame between the inner coil and the vertex of the third spacer frame.

11. The method of claim 9, wherein the outer helical coil is D-shaped such that it has a substantially planar surface.

12. The method of claim 11, wherein the inner coil and the outer coil are each in thermal contact with the base portion of the support frame.

13. The method of claim 11, wherein each of the first end of the heating apparatus and the second end of the heating apparatus terminate in a position that is parallel to the longitudinal direction of the plurality of rings.

14. The method of claim 13, wherein the first end of the heating apparatus and the second end of the heating apparatus terminate adjacent to the top portion of the support frame.

15. The method of claim 9, wherein the support frame further comprises a body portion that has a first end that is coupled to the top portion and a second end that is coupled to the base portion.

16. A heating system comprising:

a heater for heating a fluid;

a supply line with a first end coupled to the heater and a second end coupled to a first end of an exposed tube, wherein the heated fluid is operable to flow through the supply line away from the heater toward the tube;

a return line with a first end coupled to the heater and a second end coupled to a second end of the exposed tube, wherein the heated fluid is operable to flow through the return line back to the heater;

the exposed tube formed into an outer coil and an inner coil, wherein:

each coil is formed of a plurality of rings that are arranged to extend in a longitudinal direction;

the outer coil is formed around the inner coil with a gap separating the outer coil and the inner coil; and the first end of the tube terminates the outer coil and the second end of the tube terminates the inner coil;

a support frame comprising a base portion, a body portion, and a top portion, wherein:

the top portion is arranged transverse to the longitudinal direction of the plurality of rings;

the body portion having a first end that is coupled to the top portion and a second end that is coupled to the base portion; and the base portion comprises a plurality of legs and is arranged transverse to the longitudinal direction of the plurality of rings;

a first spacer frame that extends from the top portion of the support frame to the base portion of the support frame, the first spacer frame having a first frame portion and a second frame portion that meet at a vertex, the first and second frame portions having a plurality of apertures formed therein, each aperture operable to support a corresponding ring of the outer coil such that at least one ring of the outer coil is separated from at least one other ring of the outer coil, wherein the vertex is positioned between the inner coil and the outer coil; and a first spacer rod having a first end that couples to the top portion of the support frame and a second end that couples to the base portion of the support frame, wherein the first spacer rod is threaded through the first spacer frame between the outer coil and the vertex of the first spacer frame;

a second spacer frame that extends from the top portion of the support frame to the base portion of the support frame along a different portion of the outer coil than the first spacer frame, the second spacer frame having a first frame portion and a second frame portion that meet at a vertex, the first and second frame portions having a plurality of apertures formed therein, each aperture operable to support a corresponding ring of the outer coil such that at least one ring of the outer coil is separated from at least one other ring of the outer coil, wherein the vertex is positioned between the inner coil and the outer coil; and a second spacer rod having a first end that couples to the top portion of the support frame and a second end that couples to the base portion of the support frame, wherein the second spacer rod is threaded through the second spacer frame between the outer coil and the vertex of the second spacer frame.

17. The system of claim 16, the heating apparatus further comprising:

a third spacer frame that extends from the top portion of the support frame to the base portion of the support frame, the third spacer frame having a first frame portion and a second frame portion that meet at a vertex, the first and second frame portions having a plurality of apertures formed therein, each aperture operable to support a corresponding ring of the inner coil such that at least one ring of the inner coil is separated from at least one other ring of the inner coil, wherein the vertex is positioned between the inner coil and the outer coil; and a third spacer rod having a first end that couples to the top portion of the support frame and a second end that couples to the base portion of the support frame, wherein the third spacer rod is threaded through the third spacer frame between the inner coil and the vertex of the second spacer frame.

* * * * *